US008752822B2

(12) United States Patent
Suzuki

(10) Patent No.: US 8,752,822 B2
(45) Date of Patent: Jun. 17, 2014

(54) SHEET FEEDING APPARATUS AND IMAGE FORMING SYSTEM

(75) Inventor: Tomoo Suzuki, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 48 days.

(21) Appl. No.: 12/810,834

(22) PCT Filed: Aug. 31, 2009

(86) PCT No.: PCT/JP2009/065176
§ 371 (c)(1),
(2), (4) Date: Jun. 25, 2010

(87) PCT Pub. No.: WO2010/032605
PCT Pub. Date: Mar. 25, 2010

(65) Prior Publication Data

US 2011/0163491 A1 Jul. 7, 2011

(30) Foreign Application Priority Data

Sep. 16, 2008 (JP) ..... 2008-236160

(51) Int. Cl.
*B65H 3/14* (2006.01)

(52) U.S. Cl.
USPC ..... 271/98; 271/97; 271/11

(58) Field of Classification Search
USPC ..... 271/97, 98, 5, 11, 112
See application file for complete search history.

(56) References Cited

U.S. PATENT DOCUMENTS

| | | | | |
|---|---|---|---|---|
| 4,768,769 | A * | 9/1988 | Roller | 271/11 |
| 5,090,676 | A * | 2/1992 | Matsuno et al. | 271/12 |
| 5,478,066 | A * | 12/1995 | Yoshida et al. | 271/12 |
| 5,645,274 | A * | 7/1997 | Ubayashi et al. | 271/94 |
| 6,863,272 | B2 * | 3/2005 | DiNatale et al. | 271/97 |
| 7,007,944 | B1 * | 3/2006 | Dobbertin et al. | 271/98 |
| 7,364,150 | B2 * | 4/2008 | Nakane | 271/97 |

(Continued)

FOREIGN PATENT DOCUMENTS

| | | |
|---|---|---|
| EP | 0 612 680 A1 | 8/1994 |
| JP | 4-116034 | 4/1992 |

(Continued)

OTHER PUBLICATIONS

English-language International Search Report from the Japanese Patent Office mailed Oct. 6, 2009, for International Application No. PCT/JP2009/065176.

(Continued)

*Primary Examiner* — Ernesto Suarez
(74) *Attorney, Agent, or Firm* — Finnegan, Henderson, Farabow, Garrett & Dunner, L.L.P.

(57) ABSTRACT

A high productivity sheet feeding apparatus in which there is no occurrence of abnormalities related to sheet feeding irrespective of the size and type of sheet, and an image forming system having that sheet feeding apparatus are provided. This sheet feeding apparatus has the feature that it has, a stacking unit for stacking sheets, a conveying unit that is placed above and spaced from said stacking unit and that conveys the sheets, a flotation unit that makes the sheets in the upper part of the sheets stacked in said stacking unit float up towards said conveying unit, and a suction unit that sucks the air included in between the plurality of sheets that have been made to float up towards said conveying unit by said flotation unit.

7 Claims, 6 Drawing Sheets

(56) References Cited

U.S. PATENT DOCUMENTS

| | | | | |
|---|---|---|---|---|
| 2006/0170145 | A1* | 8/2006 | Nakane | 271/97 |
| 2007/0194514 | A1* | 8/2007 | Ikeda | 271/97 |
| 2008/0217838 | A1* | 9/2008 | Roberts et al. | 271/97 |
| 2011/0193285 | A1* | 8/2011 | Kadowaki | 271/5 |

FOREIGN PATENT DOCUMENTS

| | | |
|---|---|---|
| JP | 6-298388 | 10/1994 |
| JP | 2002-2986 | 1/2002 |
| JP | 2003-182873 | 7/2003 |
| JP | 2005-162419 | 6/2005 |

OTHER PUBLICATIONS

Office Action issued by the SIPO mailed Apr. 16, 2012.

European Search Report, dated Jul. 9, 2013 for EP Patent Application No. 09 81 4450; Date of drafting Jun. 28, 2013.

* cited by examiner

SHEET FEEDING APPARATUS AND IMAGE FORMING SYSTEM

TECHNICAL FIELD

The present invention relates to a separating and feeding apparatus that definitely carries out the separating and feeding of sheets, to sheet feeding apparatuses having such separating and feeding apparatuses, and to image forming systems having such sheet feeding apparatuses and image forming apparatuses.

BACKGROUND

In order to meet large quantity and short delivery time printing requirements from customers, in recent years sheet feeding apparatuses that continuously supply large quantities of sheets at a high speed, or image forming systems in which image forming apparatuses and said sheet feeding apparatuses are connected have become necessary.

As a sheet feeding apparatus of this type, apparatuses have been known that are provided with a flotation section that causes the upper part of the sheets stacked in a stacking section to float, a separating section that separates the sheets that have been floated by the flotation section, and a sheet conveying section of the belt type that conveys a sheet that has been separated by the separating section while sucking it.

In concrete terms, the flotation section and the separating section use nozzles for flotation and nozzles for separation provided on a single air flow duct;

by blowing air from the nozzle for floating at the end part of the sheets stacked in the stacking section, and by causing air to flow between sheets, causes a plurality of sheets to float, by blowing air from the nozzle for separation on the side of the conveying section, and the air repelled from the conveying section is made to come in contact with the floated sheets thereby separating them;

by providing a suction box inside a belt passed over a pair of rollers, causing a negative pressure inside the suction box, a sheet is conveyed while sucking and holding it (see, for example, Patent Document 1).

Further, sheet feeding apparatuses are known (see, for example, Patent Document 2) that have nozzles for flotation and nozzles for separation provided on a single air flow duct; and that, using an ON/OFF mechanism that turns ON/OFF the fan that blows air to the single air flow duct, and by turning ON/OFF the air that is ejected from the nozzle for flotation and the nozzle for separation at prescribed timings, carry out sheet flotation and sheet separation.

Further, even the size and type (for example, grammage) of the required output sheet are varied, for example from A3 size to post card size, grammage of 300 g/m$^2$ to 60 g/m$^2$, and generally it is known that sheets of a small size and small grammage can easily flutter at the time of picking up the sheet.

Patent Document 1: Unexamined Japanese Patent Application Publication No. 2002-2986.

Patent Document 2: Unexamined Japanese Patent Application Publication No. 2005-162419.

SUMMARY OF THE INVENTION

Problems to be Solved by the Invention

However, in the sheet feeding apparatus described in Patent Document 1, since flotation and separation are carried out by blowing air between sheets, particularly in the case of small sized or small grammage sheets, the flotation is done even with very small air flow, the sheets can flutter easily, and there was the problem that abnormalities related to sheet feeding are likely to occur such as deterioration in the orientation, folding and bending, or jamming of sheets, or feeding of multiple sheets overlapping one another, etc.

Further, it is difficult for the floated particularly small size or small grammage sheets to fall down in a short time due to the air flow, and there is the problem that, in order to make them fall down definitely, it is necessary to reduce the number of output sheets per unit time (the productivity).

Further, although there is the method of weakening the air flow that is ejected in order to reduce this fluttering, if the air flow is weakened, although an improvement is made in the case of small sized sheets, there is the problem that the ability to separate decreases since ejection of a certain amount of strong air flow is necessary to separate the sized sheets, and it is difficult to achieve both at the same time.

Further, in the sheet feeding apparatus described in Patent Document 2, it is necessary to turn ON/OFF the air ejected from the flotation section and the separation section, and this is done by the ON/OFF control of the fan.

However, for achieving higher speeds in recent years, it is necessary to carry out separation in a short time such as less than 100 ms, it is likely that it is not possible to turn ON/OFF the air flow in such a short time by turning ON/OFF the fan, and there was the problem that it is possible that the required high speed could not be met.

The present invention was made in view of the above problems, and an object of the present invention is, during sheet feeding, by suppressing fluttering of the sheet, preventing the occurrence of abnormalities in sheet feeding described above and the reduction in productivity, and also, making it possible to carry out separation in a short period of time such as less than 100 ms, etc., and thereby to provide a high productivity sheet feeding apparatus in which there is no occurrence of abnormalities in sheet feeding irrespective of the sheet size and type, and to provide an image forming system having such a sheet feeding apparatus.

Means to Solve the Problems

The above object is achieved by the following structures.

1. A sheet feeding apparatus comprising: a stacking unit for stacking sheets, a conveying unit for conveying sheets, wherein the conveying unit is placed above and spaced from said stacking unit, a flotation unit that floats sheets in an upper part of the sheets stacked in said stacking unit towards said conveying unit, and a suction unit that sucks air included in between a plurality of sheets floated by said flotation unit towards said conveying unit.

2. The sheet feeding apparatus according to the item 1, comprising a separation unit that, among the plurality of sheets that are floated by said flotation unit towards said conveying unit, separates a first sheet at a topmost part from the other sheets.

3. The sheet feeding apparatus according to item 1, wherein said flotation unit comprises: a first air blowing outlet that is opened in a direction parallel to a direction in which a sheet is conveyed by said sheet conveying unit and the air blowing outlet blows air towards an end surface of an upper part of the sheets stacked in said stacking unit; and a first air blowing unit that blows air towards said first air blowing outlet.

4. The sheet feeding apparatus according to item 1, wherein said suction unit comprises: a suction inlet that is positioned on a downstream side in a direction of sheet conveying by said conveying unit and the suction inlet is opened in a direction perpendicular to the direction of sheet conveying by said conveying unit; and a suction device that sucks air from said suction inlet.

5. The sheet feeding apparatus according to item 2, wherein separation unit said comprises: a second air blowing outlet that is positioned on a downstream side in a direction of sheet conveying by said conveying unit, the second blowing outlet is opened in a direction perpendicular to the direction of sheet conveying by said sheet conveying unit and blows air towards said conveying unit; and a second air blowing unit that blows air towards said second air blowing outlet.

6. The sheet feeding apparatus according to item 1, wherein said conveying unit comprises: a pair of rollers; a driving motor that rotationally drives said rollers; a belt stretched around and supported by said rollers; a suction box that is placed inside said belt and sucks a sheet; and a suction device that sucks air from the suction box.

7. The sheet feeding apparatus according to item 4, wherein said suction inlet is an opening that is provided on a lower side of the second air blowing outlet that blows air towards said conveying unit, and that extends from a bottom edge of said second air blowing outlet, in a vertical direction, to a position above a prescribed dimensions from a position same as the bottom edge of said first blowing outlet that blows air towards an end surface of an upper part of the sheets stacked in said stacking unit, said second air blowing outlet is positioned on a downstream side in the direction of sheet conveying by said conveying unit, opens in a direction perpendicular to the direction of sheet conveying by said conveying unit, and said first air blowing outlet opens in a direction parallel to the direction of sheet conveying by said conveying unit.

8. The sheet feeding apparatus according to item 1, wherein a second air blowing outlet that is positioned on a downstream side of said conveying unit opens in a direction perpendicular to the direction of sheet conveying by said conveying unit and blows air towards said conveying unit; a second air blowing unit that blows air towards said second air blowing outlet is always ON and air is blown from said second blowing outlet; a suction inlet that is positioned on a downstream side of said conveying unit opens in a direction perpendicular to the direction of sheet conveying by said conveying unit; and a suction device that sucks air from said suction inlet is always ON and air is sucked from said suction inlet.

9. An image forming system comprising: a sheet feeding apparatus including: a stacking unit for stacking sheets, a conveying unit for conveying sheets, the conveying unit is placed above and spaced from said stacking unit, a flotation unit that floats sheets in an upper part of the sheets stacked in said stacking unit towards said conveying unit, and a suction unit that sucks air included in between a plurality of sheets floated by said flotation unit towards said conveying unit; and an image forming apparatus that is connected to said sheet feeding apparatus on a downstream side of said sheet feeding apparatus and forms images.

Effect of the Invention

According to the above invention, it is possible, during sheet feeding, by suppressing fluttering of the sheet, to prevent the occurrence of abnormalities in sheet feeding described above and the reduction in productivity, and also, by making it unnecessary to turn ON/OFF the air blow in the separation section, it is possible to carry out separation in a short time, and thereby to provide a high productivity sheet feeding apparatus in which there is no occurrence of abnormalities in sheet feeding irrespective of the sheet size and type, and to provide an image forming system having such a sheet feeding apparatus.

PREFERRED EMBODIMENT OF THE INVENTION

In the following, detailed descriptions are given of an image forming system having a sheet feeding apparatus that can store and supply large quantities of sheets and that has a stacking section for stacking sheets, a conveying section that conveys sheets and that is placed above and spaced from said stacking section, a flotation section that floats sheets in the upper part of the sheets stacked in said stacking section towards said conveying section, and a suction unit that sucks the air included in between the plurality of sheets floated by said flotation section towards said conveying section, and an image forming apparatus that forms images on the sheets fed by said sheet feeding apparatus.

As the materials for the sheets supplied from the sheet feeding apparatus, it is possible to use paper, plastic (for example, OHP sheets), etc.

In the following explanations, the upstream side indicates the direction towards the side from which the sheets are conveyed, and the downstream side indicates the direction towards the side to which the sheets are conveyed.

The width is the side at right angles to the direction of conveying the sheets, and the length is the side that is parallel to the direction of conveying the sheets.

Figure 1:
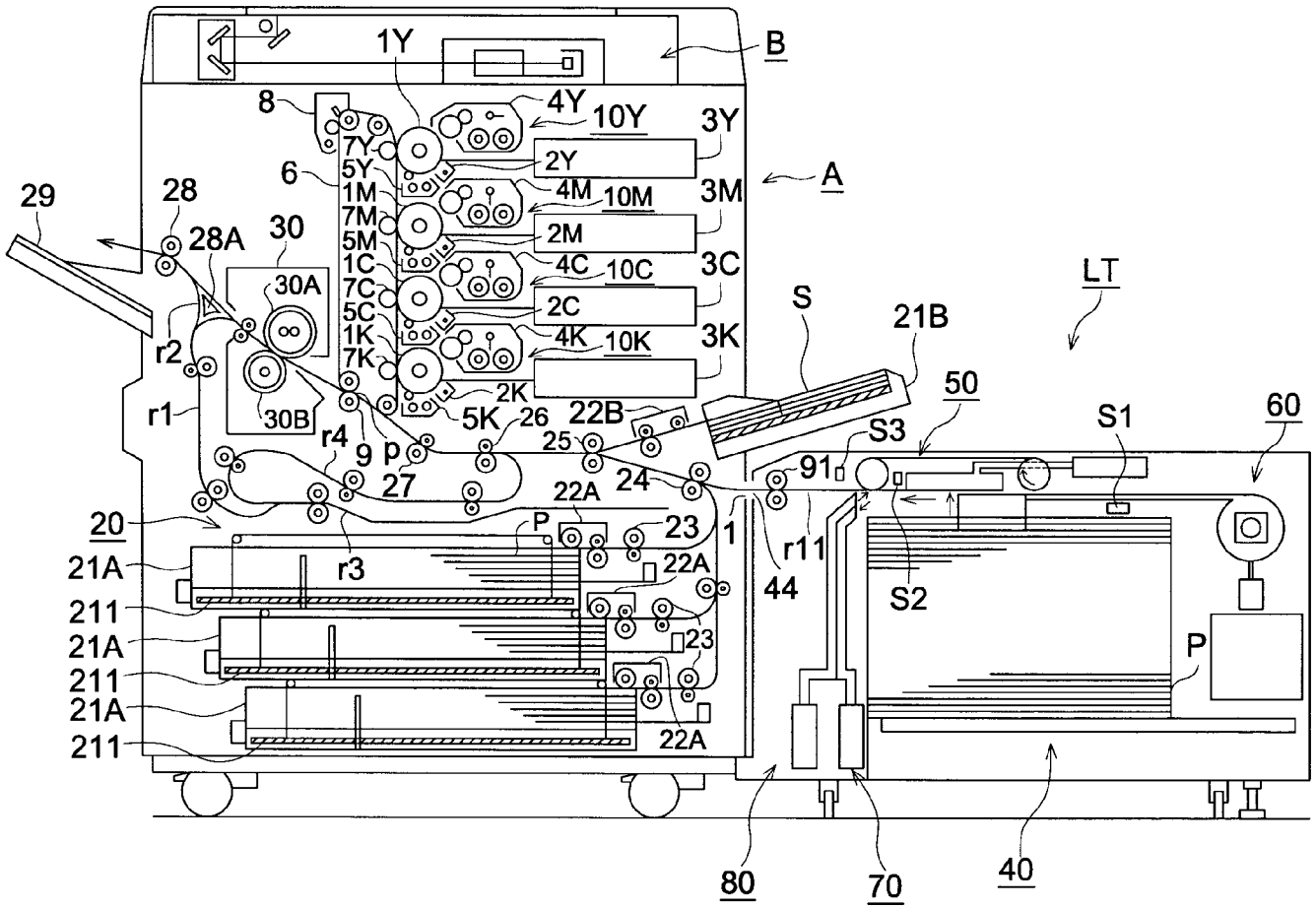
FIG. 1 is a diagram showing one example of an image forming system having a sheet feeding apparatus and an image forming apparatus.

FIG. 1 is a diagram showing one example of an image forming system having a sheet feeding apparatus and an image forming apparatus.

The image forming apparatus A is one that is called a tandem type color image forming apparatus, and has plural sets of image forming mechanisms 10Y, 10M, 10C, and 10K, a belt shaped intermediate image transfer member 6, a sheet feeding apparatus 20, and a fixing unit 30, etc.

Above the image forming apparatus A is installed an original document image reading device B.

The document image of the document placed on the document table is scanned and exposed by the optical system of the document image scanning and exposing section of the original document reading device B, and the reflected light according to the original document images is read by a line image sensor.

The analog signal of the original document image which is converted photo-electrically by the line image sensor is, after being subjected in the image processing section not shown in the figure to analog processing, A/D conversion, shading correction, image compression processing, etc., input as a digital signal to the exposure mechanisms 3Y, 3M, 3C, and 3K The image forming mechanism 10Y that forms images of yellow color (Y), has a charging mechanism 2Y, an exposure mechanism 3Y, a developing unit 4Y, and a cleaning mechanism 5Y which are placed along the circumferential periphery of a photoreceptor drum 1Y functioning as an image carrier.

The image forming mechanism 10M that forms images of magenta color (M), has a charging mechanism 2M, an exposure mechanism 3M, a developing unit 4M, and a cleaning mechanism 5M which are placed along the circumferential periphery of a photoreceptor drum 1M functioning as an image carrier.

The image forming mechanism 10C that forms images of cyan color (C), has a charging mechanism 2C, an exposure mechanism 3C, a developing unit 4C, and a cleaning mechanism 5C which are placed along the circumferential periphery of a photoreceptor drum 1C functioning as an image carrier.

The image forming mechanism 10K that forms images of black color (K), has a charging mechanism 2K, an exposure mechanism 3K, a developing unit 4K, and a cleaning mechanism 5K which are placed along the circumferential periphery of a photoreceptor drum 1K functioning as an image carrier.

The charging mechanism 2Y and the exposure mechanism 3Y, the charging mechanism 2M and the exposure mechanism 3M, the charging mechanism 2C and the exposure mechanism 3C, and the charging mechanism 2K and the exposure mechanism 3K constitute latent image forming mechanisms, respectively.

The developing units 4Y, 4M, 4C, and 4K make the latent image an apparent image using two component developing agents having small particle diameter toners of the color yellow (Y), magenta (M), cyan (C), and black (K) and a carrier.

The intermediate image transfer member 6 can carry the toner image, and is wound around a plurality of rollers, and is supported in a rotatable manner.

The toner images of different colors formed by the image forming mechanisms 10Y, 10M, 10C, and 10K are successively transferred onto the rotating intermediate image transfer member 6 by the primary image transfer mechanisms 7Y, 7M, 7C, and 7K (primary transfer), whereby a color image is synthesized.

A sheet P stored in the sheet feeding cassette 21A of the sheet feeding apparatus 20 is picked up by the sheet feeding mechanism 22A, passes through the conveying rollers 23, 24, 25, and the loop roller 26, and the registration roller 27, and is conveyed to the transfer area p.

Further, the transfer area p is the part where the transfer roller 9 and the intermediate image transfer member 6 are opposite each other, and the color image carried on the intermediate image transfer member 6 is transferred on to the sheet P (secondary transfer).

The sheet P on which a color image has been transferred is subjected to heat and pressure by the heating roller 30A and the pressure roller 30B in the fixing unit 30.

Because of this, the toner image on the sheet P is fixed and made to adhere firmly to the sheet P, gripped and held by the sheet discharging roller 28 and is placed on the sheet discharge tray 29 outside the apparatus.

Further, after the color image is transferred to the sheet P, the intermediate image transfer member 6 is separated by curvature from the sheet P, and the residual toner on the intermediate image transfer member 6 is removed by the cleaning mechanism 8.

When the fixed sheet P is to be discharged after inverting, the sheet P passes through the conveying path in the bottom part of the figure of the branching plate 28A placed in between the fixing unit 30 and the sheet discharging roller 28, after being conveyed to the bottom conveying path r1, is reverse conveyed and passes through the conveying path r2 on the left side in the figure of the branching plate 28A, and is discharged to outside the apparatus by the sheet discharging roller 28.

When printing is to be made on both sides of the sheet P, after carrying out fixing operation of the image formed on the first surface of the sheet P, after the sheet P is introduced into the conveying path r1 and further into the conveying path r3, it is reverse conveyed, and conveyed to the conveying path r4.

Further, the sheet that has been turned upside down passes through the loop roller 26 and the registration roller 27, etc., and is conveyed to the transfer area p.

Next, a color image is transferred on to the second surface of the sheet which is the underside of the first surface, subjected to fixing by heating in the fixing unit 30, and is discharged to outside the apparatus by the sheet discharging roller 28.

In the image forming apparatus A, a manual sheet feeding tray 21B has been installed.

The sheet P put inside the manual sheet feeding tray 21B is fed by the sheet feeding mechanism 22B, passed through the conveying roller 25, loop roller 26, and registration roller 27, and is fed to the transfer area p, and image formation is made as described above.

Further, although the image forming apparatus A described above is an image forming apparatus that forms color images, it can also be an image forming apparatus that forms monochrome images.

When configuring as an image forming system, on the upstream side of the image forming apparatus A is coupled, for example, a sheet feeding apparatus LT that stores a large quantity of sheets, for example, 1000 sheets or more, and separates the sheets one sheet at a time and feeds them, and the sheets are supplied to the image forming apparatus A from the sheet feeding apparatus LT.

The sheet feeding apparatus LT supplies sheets from its discharge outlet 44 to the receiving inlet 1 of the image forming apparatus A. Because of this, the sheet feeding apparatus LT and the image forming apparatus A are installed so that the discharge outlet 44 and the receiving inlet 1 are at the same position.

The outline of a sheet feeding apparatus LT is explained below.

The sheet feeding apparatus LT has, a stacking section 40 for stacking sheets P, a conveying section 50 that is placed above and spaced from the stacking section 40 and that conveys sheets P towards the discharge roller 91, a flotation section 60 that floats towards the conveying section 50 the sheets P in the upper part of the sheets stacked in the stacking section 40, a suction unit 70 that sucks the air in between the plurality of sheets that have been floated towards the conveying section 50 by the flotation section 60, a separation section 80 that blows air towards the conveying section 50 and separates the topmost sheet (the first sheet), for example the sheet that has been sucked and adhered to the conveying section 50, from the second sheet.

Figure 2:
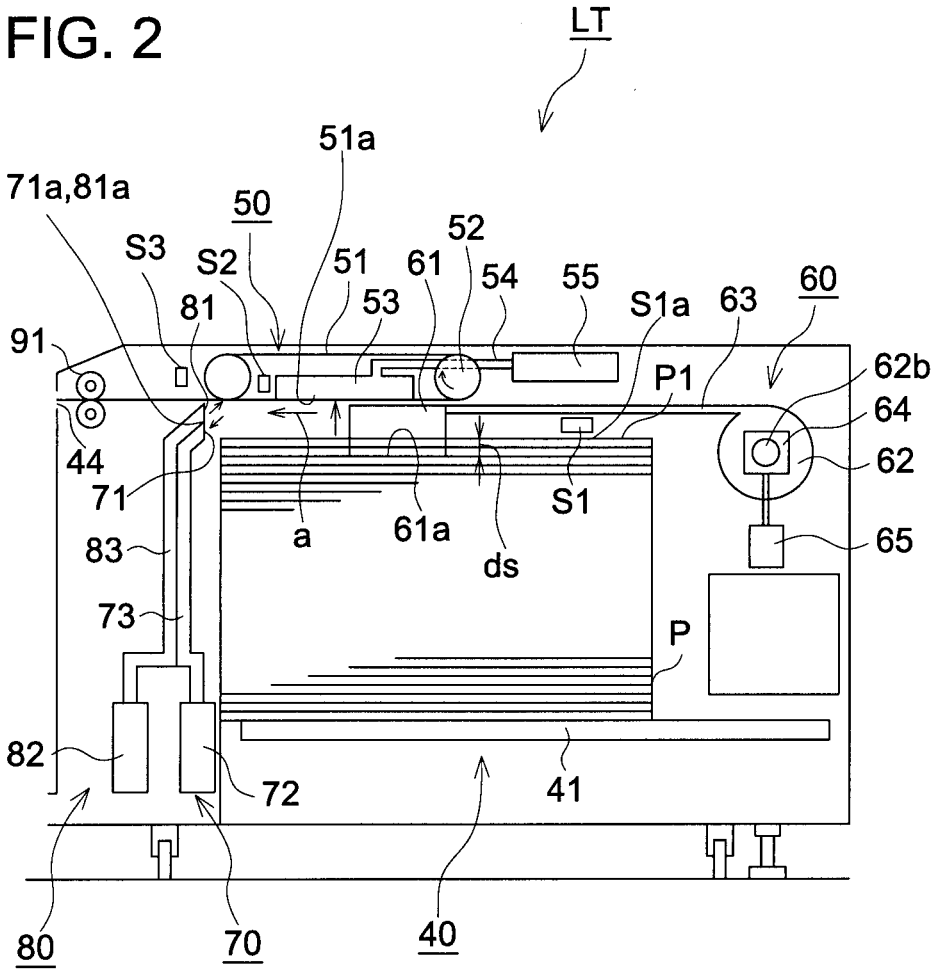
FIG. 2 is a diagram showing one example of a sheet feeding apparatus.

FIG. 2 is a diagram showing one example of a sheet feeding apparatus.

In the following, the sheet feeding apparatus is explained in detail.

The stacking section 40 that stacks sheets P has a stacking plate 41 for stacking sheet on it, and a stacking plate movement mechanism not shown in the figure for moving the stacking plate 41 in the sheet stacking direction (up down direction in the figure).

Further, said stacking plate movement mechanism, based on the detection information of the sheet top surface detection sensor S1, moves the stacking plate 41 so that the position (height) of the topmost sheet P stacked on the stacking plate 41 is at a prescribed position (height).

The conveying section 50 has a belt 51 that sucks and conveys the topmost sheet P among the sheets stacked in the stacking section 40, a pair of belt driving rollers 52 that support the belt 51 and rotate it in the direction of the arrow, a belt drive motor not shown in the figure that rotationally drives the belt driving rollers 52, a suction box 53 that is placed inside the belt 51 and that sucks the sheet, a suction device 55 that sucks the air inside the suction box 53, and a duct 54 that connects the suction box 53 to the suction device 55.

In other words, the conveying section 50 has a pair of rollers, a driving motor that rotationally drives those rollers, a belt that is wound round said rollers, a suction box that is placed inside the belt and that sucks the sheet, and a suction unit that sucks the air inside said suction box.

The belt 51 is constituted from a plurality of belts arranged along the width direction. Further, it can also be configured using belts having a plurality of holes, or from porous belts that allow air to pass through them.

Further, on the inside of the belt 51, a suction box 53 is provided for sucking the sheets P stacked in the stacking section 40, and the suction box 53 is connected via a duct 54 to a suction device 55.

Due to the operation of the suction device 55 that sucks air from the suction box 53, the pressure inside the suction box 53 becomes a negative pressure, air is sucked through the gap between said plurality of belts (or through the holes in said belt with a plurality of holes, or through the fine holes in said porous belt), and it becomes possible for the topmost sheet P in the stacking section 40 to be sucked and adhered to the belt 51.

Because of this, the conveying section 50 sucks a sheet P, and due to the operation of the belt driving motor not shown in the figure that drives the belt driving rollers 52, it is possible to convey the sheet towards the discharge roller 91.

Further, due to the discharge motor not shown in the figure, the discharge roller 91 discharges the sheet from the discharging outlet 44.

A suction confirmation detection sensor S2 that detects that the sheet P has been sucked and adhered to the belt 51 is provided on the inside of the belt 51 and on the downstream side.

The flotation section 60 that floats towards the conveying section 50 the sheets stacked in the upper part of the stacking section 40 has, a first air ejection outlet 61 that opens in a direction parallel to the direction of the sheets being conveyed by the conveying section 50, and that blows air towards the end surface of the upper part of the sheets P stacked on the stacking plate 41 of the stacking section 40, a first air blower 62 that blows air towards the first air ejection outlet 61, a duct 63 that connects the first air ejection outlet 61 and the first air blower 62, a shutting off plate 64 that can shut off (open and close) the air inlet of the first air blower 62, and a solenoid 65 that moves the shutting off plate 64 in the up and down direction in the figure thereby opening or closing said air inlet.

The first air blower 62 is configured from a sirocco fan.

The first air ejection outlet 61 of the flotation section 60 is an opening that opens in a direction parallel to the direction of the sheets being conveyed by the conveying section 50, and is an opening that extends, in the up down direction in the figure, from the bottom surface 51*a* of the belt 51 that is facing opposite said conveying section 50 towards the down side in the figure, up to a position at a prescribed distance dS, for example, 5 to 10 mm, from the bottom side of the sheet detection position S1*a* of the sheet top surface detection sensor S1.

By having a configuration as described above, the flotation section 60, due to the operation of the first air blower 62, can eject air towards the upper part end surface of the sheets P stacked on the stacking plate 41 of the stacking section 40, by blowing air between the different sheets in the upper part of the sheets stacked on the stacking plate 41, the sheets P in the upper part of the sheets stacked on the stacking plate 41 can be made to float towards the belt 51 of the conveying section 50.

Further, the position of installing the sheet top surface detection sensor S1 in the up and down direction is such that, the sheets in the vicinity of the topmost part detected at the sheet detection position S1*a* can be made to float easily by the flotation section 60, and also, the sheets that are floated can easily be separated by the separation section 80 described below.

The separation section 80 that that blows air towards the conveying section 50 and separates the topmost sheet (the first sheet) stacked in the stacking section 40, for example the sheet that has been sucked and adhered to the conveying section 50, from the second sheet, has a second air ejection outlet 81 that is positioned on the downstream side of the conveying section 50, opens in a direction perpendicular to the direction of sheet conveying by the conveying section 50, a second air blower 82 that blows air towards the second air ejection outlet 81, and a duct 83 that connects the second air ejection outlet 81 and the second air blower 82.

The second air ejection outlet 81 is an opening that is positioned on the downstream side of the conveying section 50, opens in a direction perpendicular to the direction of sheet conveying by the conveying section 50, and extends, in the up down direction in the figure, from roughly the same position as the bottom edge 51*a* of the belt 51 of said conveying section 50 towards the down side, up to the bottom side of the sheet roughly the same position as that of the top edge 71*a* of the suction inlet 71 of the suction unit 70 to be described later.

The second air blower 82 is always ON and blows air towards the second air ejection outlet 81 at all times.

By having a configuration as described above, the separation section 80, due to the operation of the second air blower 82, can eject air towards the conveying section 50, and ejects air between, at least the topmost sheet among the sheets stacked in the stacking section 40, that is the sheet that is sucked by and adhered to the conveying section 50, and the second sheet and onwards due to the operation of the second air blower 82, applies a downward force on the sheets that are positioned at the second sheet and lower, and can separate even if, for example, a plurality of sheets becomes a bundle and get floated.

The suction unit 70 has, a suction inlet 71 as an opening that is positioned on the downstream side of the conveying section 50, opens in a direction that is perpendicular to the direction of sheet conveying by the conveying section 50, and that sucks air in between the plurality of sheets P that are floated by the flotation section 60 towards the belt 51 of the conveying section 50, a suction unit 72 that sucks air from the suction inlet 71, and a duct 73 (the third duct) that connects the suction inlet 71 and the suction device 72.

The suction inlet 71, in the up down direction in the figure, is an opening that opens downward from about the same position as the lower edge 81*a* of the second air ejection outlet 81 and extends by a prescribed dimension towards above the bottom edge 61*a* of the first air ejection outlet 61.

However, the prescribed dimension is a distance equal to about the distance from the lower edge 61*a* of the first air ejection outlet to the sheet detection position S1*a*, and the prescribed distance dS is for example 5 to 10 mm.

In other words, this is an opening that is placed on the lower side of the second air ejection outlet 81, and extends, towards below from the lower edge of the second air ejection outlet 81, in the up down direction, towards above by a prescribed dimension from about the same position as that of the lower edge of the first air ejection outlet 61.

Here, the suction device 72 is always ON, sucks air from the suction inlet 71 at all times, and sucks the air in between the plurality of sheets P that are floated up towards the belt 51 of the conveying section 50 by the flotation section 60.

The suction device 72 is configured from a sirocco fan.

By having a configuration as described above, the suction unit 70, due to the operation of the suction device 72, can suck air from between the sheets floated towards the belt 51, and due to this suction, by pushing in a stable manner towards the stacking section 40 the sheets floating towards the belt 51, it is possible, irrespective of the type (for example, the grammage) and size of the sheet, to prevent the fluttering that can easily occur particularly in the case of thin (small grammage) sheets, and to prevent the occurrence of abnormalities related to sheet feeding.

Further, as has been explained above, by making it possible to operate the second air blower 82 and the suction device 72 at all times, it is not necessary to turn ON/OFF at a high speed the member related to air blow, etc., and hence, it is possible to carry out separation in a time such as less than 100 ms, etc., and also, the control and devices for turning ON/OFF become unnecessary, the manufacturing cost of the apparatus decreases, and the probability of fault occurrence decreases.

Further, it is possible to eliminate the instability of the behavior of the sheet due to turning ON/OFF, and stable supply of sheets becomes possible.

Further, the suction device 72 can suck at least a part of the air ejected from the first air blower 62 of the flotation section 60 and the second air blower 82 of the separation section 80.

The strength, quantity, and speed of the air ejected from the first air ejection outlet 61 of the flotation section 60 and the second air ejection outlet 81 of the separation section 80, and the strength, quantity, and speed of the air sucked from the suction inlet 71 of the suction unit 70 are, after carrying out experiments in advance, and obtaining the values at which the floated sheets do not flutter, stored in a storage member such as a ROM (Read Only Memory).

Further, during sheet feeding, by a control apparatus not shown in the figure, the values that ensure that the sheets do not flutter and that are stored in said storage member are read out, and the fluttering of the floated sheets is suppressed by controlling the first air blower 62 of the flotation section 60, the second air blower 82 of the separation section 80, and the suction device 72 of the suction unit 70, and also, the floating sheet is made to return to the top of the stacking section 40 in a short period of time.

Figure 3:
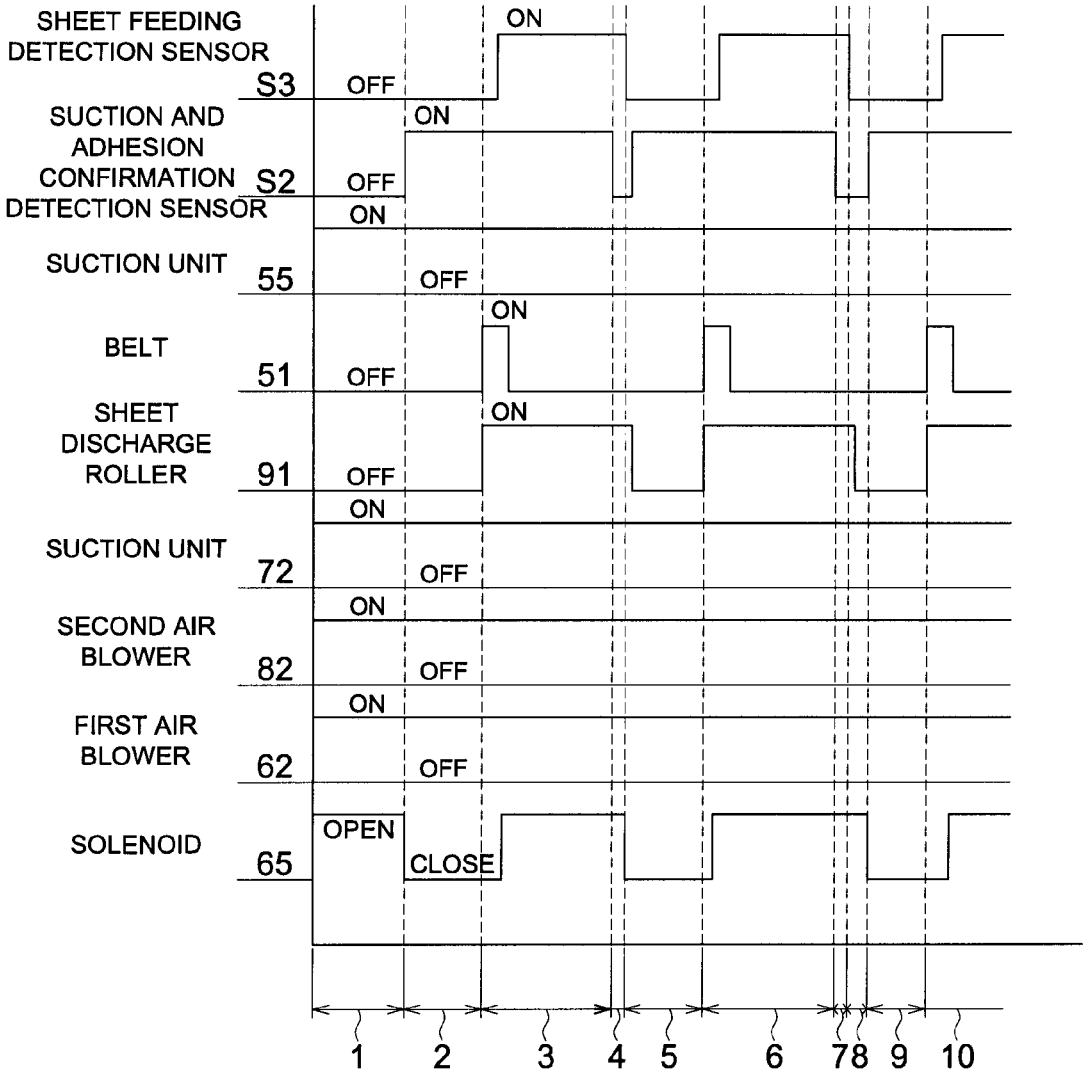
FIG. 3 is a timing diagram showing the operational states of the different members of a sheet feeding apparatus.

FIG. 3 is a timing diagram showing the operation states of the different members of the sheet feeding apparatus.

Along the vertical axis are shown the solenoid 65 that opens and closes the suction inlet of the flotation section 60, the first air blower 62 of the flotation section 60, the second air blower 82 of the separation section 80, the suction device 72 of the suction unit 70, the sheet discharge roller 91, the belt 51 of the conveying section 50, the suction device 55 that sucks air from the suction box 53 of the conveying section 50, the suction confirmation detection sensor S2 that detects that the sheet P has been sucked by and adhered to the belt 51, and the sheet feeding detection sensor S3 that is positioned on the downstream side of the belt 51 and detects the sheet, and along the horizontal axis is shown the passage of time, and the first area to the tenth area are shown from left to right in the figure.

The suction device 55, the first air blower 62, the second air blower 82, and the suction device 72 are always ON.

In the first region, the solenoid 65 is ON (opens the suction inlet of the first air blower 62), and air is being ejected from the first air ejection outlet 61 from the first air blower 62 of the flotation section 60.

Further, due to the ejection of air the sheets at the upper part stacked in the stacking section 40 are floated (the first sheet, etc.,) towards the conveying section 50.

Next, when the floated first sheet is sucked by and adhered to the belt 51, and the suction confirmation detection sensor S2 becomes ON (confirmation of sheet suction and adhesion), the operation transits to the second region.

In the second region, due to the suction confirmation detection sensor S2 becoming ON, the solenoid 65 is made OFF, and the ejection of air from the first air ejection outlet 61 of the flotation section 60 is stopped.

With the first region and the second region, due to the air flow towards the conveying section 50 from the second air blower 82, the first sheet is separated from the second and subsequent sheets.

Next, a prescribed time duration after the suction confirmation detection sensor S2 becomes ON, that is, after an interval of time over which the first sheet and the subsequent sheets can be separated definitely, for example, after a period of 80 ms to 300 ms during which the separation can be made definite, the operation transits to the third region.

In the third region, the sheet discharge roller 91 is made ON thereby making it possible to discharge the first sheet.

Further, the belt driving motor which is not shown in the figure and which drives the belt driving rollers 52 is made ON (belt rotates), and the conveying of the first sheet that is sucked by and adhered to the belt 51 is started.

Further, in the following, the turning ON/OFF of the belt driving motor which is not shown in the figure and which drives the belt driving rollers 52 is indicated in the figure as turning ON/OFF of the belt 51.

Next, when the leading edge of the first sheet that is sucked by and adhered to the belt 51 is detected by the sheet feeding detection sensor S3, after the lapse of a prescribed interval of time, the belt 51 is made OFF, and the conveying of the first sheet by the belt 51 is stopped.

Further, at this time, since the sheet discharge roller 91 is continuing to be ON, the discharging of the first sheet is done only by the discharge roller 91, and the suction confirmation detection sensor S2 and the sheet feeding detection sensor S3 continue to detect the sheet.

The solenoid 65 becomes ON at the instant of time when the third region is entered, and continues to be ON after that.

Next, when the trailing edge of the first sheet passes beyond the suction confirmation detection sensor S2, the operation transits to the fourth region.

In the fourth region, due to the continuation of sheet discharging, the trailing edge of the first sheet passes beyond the sheet feeding detection sensor S3, and the sheet feeding detection sensor S3 becomes OFF.

Due to the solenoid 65 continuing to be ON, the second sheet floats up, and the second sheet is sucked by and adhered to the belt 51.

Further, when the second sheet is sucked and adhered following the first sheet, the suction confirmation detection sensor S2 continues to be ON due to the second sheet that has been sucked by and attached to the belt 51 (not shown in the figure).

Next, a prescribed time interval after the sheet feeding detection sensor S3 becomes OFF due to the trailing edge of the first sheet having passed beyond it, the operation transits to the fifth region.

In the fifth region, because the sheet feeding detection sensor S3 has become OFF due to the trailing edge of the first sheet having passed beyond it, it is judged that the discharging of the first sheet has been completed, and not only the discharge roller 91 is turned OFF but also the operations transit to the preparations for feeding the second sheet.

Due to the suction confirmation detection sensor S2 becoming ON, the solenoid 65 is made OFF, and the flotation of the second sheet is stopped.

Next, a prescribed time interval after the sheet feeding detection sensor S3 has become OFF, that is, after a time interval ensuring that the separation of the second sheet from the third and subsequent sheets can be made definitely, for example after 100 ms to 300 ms during which the separation can be made definitely, the operation transits to the sixth region.

With the fourth and fifth regions, due to the air flow towards the conveying section 50 from the second air blower 82, the second sheet is separated from its subsequent sheets.

In the sixth region, similar to in the third region, not only the belt 51 is made ON, and the conveying of the second sheet that is sucked by and adhered to the belt 51 is started, but also, the sheet discharge roller 91 is made ON thereby making it possible to discharge the second sheet.

Next, when the leading edge of the second sheet that is sucked by and adhered to the belt 51 is detected by the sheet feeding detection sensor S3, after the lapse of a prescribed interval of time, the belt 51 is made OFF, and the conveying of the second sheet by the belt 51 is stopped.

Further, at this time, since the sheet discharge roller 91 is continuing to be ON, the discharging of the second sheet is continued, and even the sheet feeding detection sensor S3 continues to detect the sheet.

Further, after transiting to the sixth region, the solenoid 65 is made ON after a prescribed time interval, air from the first air blower 62 is ejected from the first air ejection outlet 61 of the flotation section 60, and the floating of the third sheet is started.

Next, when the trailing edge of the second sheet passes beyond the suction confirmation detection sensor S2 and the suction confirmation detection sensor becomes OFF, the operation transits to the seventh region.

Further, in the seventh region, when the suction confirmation detection sensor S2 has become OFF due to the trailing edge of the second sheet having passed beyond the suction confirmation detection sensor S2, if a third sheet has been sucked by and attached to the belt 51, the sheet feeding detection sensor S3 becomes OFF.

Further, at this time, the trailing edge of the second sheet has not passed beyond the sheet feeding detection sensor S3, and that sensor is ON.

Next, when the trailing edge of the second sheet has passed beyond the sheet feeding detection sensor S3, and the sheet feeding detection sensor S3 has become OFF, the operation transits to the eighth region.

After transiting to the eighth region, after a prescribed time interval has passed (after the tailing edge of the second sheet has definitely passed beyond the sheet discharge roller 91), the sheet discharge roller 91 is made OFF thereby stopping the discharging of the second sheet, and the operation waits for the preparations for suction and adhering of the third sheet.

Further, if the next sheet has been sucked by and adhered to the belt 51, the suction confirmation detection sensor S2 does not become OFF, but the sheet feeding detection sensor becomes OFF, the sheet discharge roller 91 becomes OFF, and the operation waits for the preparations for suction and adhering of the third sheet.

Next, when the third sheet that has been floated due to the solenoid 65 becoming ON is sucked by and adhered to the belt 51 and the suction confirmation detection sensor S2 becomes ON, the operations transit to the ninth region.

In the ninth region, due to the suction confirmation detection sensor S2 becoming ON, the solenoid 65 is made OFF, and the ejection of air from the first air ejection outlet 61 of the flotation section 60 is stopped.

Next, a prescribed time interval after the suction confirmation detection sensor S2 has become ON, that is, after a time interval during which the third sheet has been definitely separated from the fourth and subsequent sheets, for example after 100 ms to 300 ms during which the separation can definitely be made, the operation transits to the tenth region.

Here, between the eighth region and the ninth region, the third sheet is separated from its subsequent sheets by the ejection of air from the second air blower 82 towards the conveying section 50.

In the tenth region, similar to in the sixth region, the belt 51 is made ON, and the conveying of the third sheet that has been sucked by and adhered to the belt 51 is started.

Next, when the leading edge of the third sheet that has been sucked by and adhered to the belt 51 is detected by the sheet feeding detection sensor S3, after a prescribed interval of time the belt 51 is made OFF, and the conveying of the third sheet by the belt 51 is stopped.

Further, at this time, since the sheet discharge roller 91 is continuing to be ON, the discharging of the third sheet is continued, and the sheet feeding detection sensor S3 is continuing to detect the third sheet.

Further, after transiting to the tenth region, after a prescribed interval of time, the solenoid 65 is made ON, air from the first air blower 62 is ejected from the first air ejection outlet 61 of the flotation section 60, the floating of the fourth sheet is started, and thereafter, the fourth and subsequent sheets are processed in a similar manner.

In the above explanations, the second air blower 82 and the suction device 72 are always ON, and in particular, in the first region and the second region, in the fourth region and the fifth region, and in the eighth region and the ninth region, at the time of separating the sheet, since the air that is collected in between the sheets due to the air ejected from the first air blower 62 and the second air blower 82 can be sucked by the suction device 72, the fluttering of the sheets is suppressed irrespective of the type (for example, the grammage) or the size of the sheet, and the sheet feeding is made stable.

Further, by opening and closing the air suction side 62*b* of the first air blower 62 of the flotation section 60 using the solenoid 65 (shutting off plate 64), it is possible to turn ON/OFF the air ejected from the first air ejection outlet 61, it is possible to prevent the fluttering of the sheet that is sucked by, attached to, and conveyed by the belt 51 of the conveying section 50, and for example, it is possible to prevent the sheet that has been sucked by and attached to the belt 51 from pulled and peeled off again.

When we carried out a comparison test of the occurrence rate of jamming of the above configuration of the present invention (a configuration having a flotation section 60, a suction unit 70, and a separation section 80) and a conventional configuration (a configuration not having a suction unit 70), when the amount of air ejected from the flotation section 60 and the separation section 80 in the conventional configuration were made equal to the normal values, the rate of occurrence of jamming was once in the feeding of 10 sheets.

Further, when the amount of air ejected from the flotation section 60 and the separation section 80 in the conventional configuration were made less than the normal values, the rate of occurrence of jamming was once in the feeding of 100 sheets.

In contrast with this, in the configuration of the present invention described above, due to the effect of sucking air between the floating sheets by the suction unit 70, the occurrence rate of jamming was 0 times in the feeding of 2000 sheets, and a very large effect was confirmed.

Further, the sheets used were of a size that causes jamming to occur relatively easily.

Sheets used: Coated sheets, grammage 84.9 g/m$^2$, A5 size, short edge feeding

Figure 4:
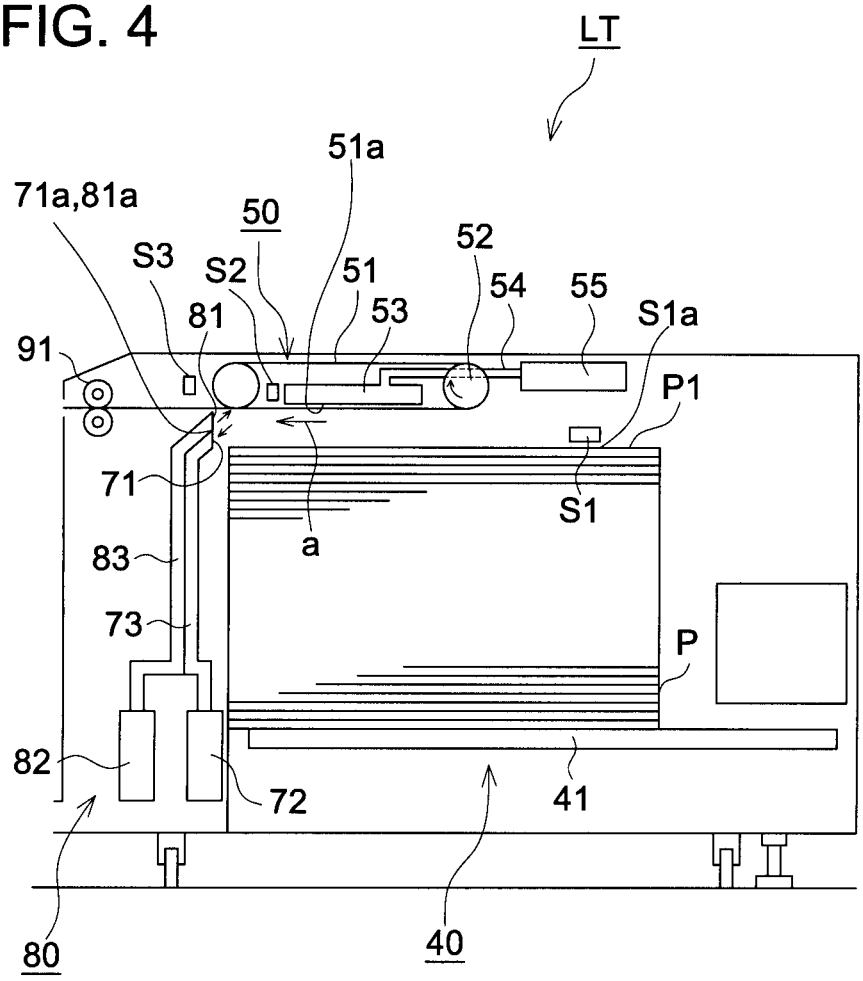
FIG. 4 is an explanatory diagram of other constructions of the flotation section.

FIG. 4 is an explanatory diagram of another configuration of the flotation section.

Another configuration is one in which, by replacing the function of floating the sheet by the flotation section 60 with the sheet suction and floating function by the suction device 55 and the suction box 53, the flotation section 60 has been made unnecessary.

In other words, by making large the negative pressure of the suction box 53 due to the suction device 55, and by directly sucking and floating the topmost sheet P1 among the sheets stacked on the stacking plate 41, the first air ejection outlet 61 and the first air blower 62 of the flotation section 60 have been made unnecessary.

Since the parts other than the flotation section and the conveying section are similar to those of the sheet feeding apparatus LT described already, the explanations of the parts other than the flotation section and the conveying section are omitted.

In concrete terms, as described above, as the suction device 55, a suction unit with a large suction force such as, for example, a blower, etc., is used, the negative pressure inside the suction box 53 provided inside the belt 51 is made large using the suction unit whose air suction capacity has been increased, and by making the air pressure low between the suction box 53 and the sheet in the upper part of the sheets stacked in the stacking section 40, the topmost sheet in the stacked sheets is sucked and pulled.

Therefore, the suction box 53, the duct 54, and the suction device 55 of the conveying section 50 replace the function of the flotation section 60, and the flotation section 60 becomes unnecessary.

Further, in order to suck and pull the sheet definitely, for example, the sheet detection position S1*a* by the sheet top surface detection sensor S1 is made higher than the detection position in the sheet feeding apparatus LT described above, and the distance between the topmost surface of the sheets stacked in the stacking section 40 and the bottom surface of the suction box 53 is made small.

By replacing the function of the flotation section 60 with the combination of the suction box 53, the duct 54, and the suction device 55 as described above, the flotation section 60 becomes unnecessary, the configuration becomes simple, and not only is it possible to reduce the manufacturing cost, but also it becomes possible to save on energy consumption.

Figure 5:
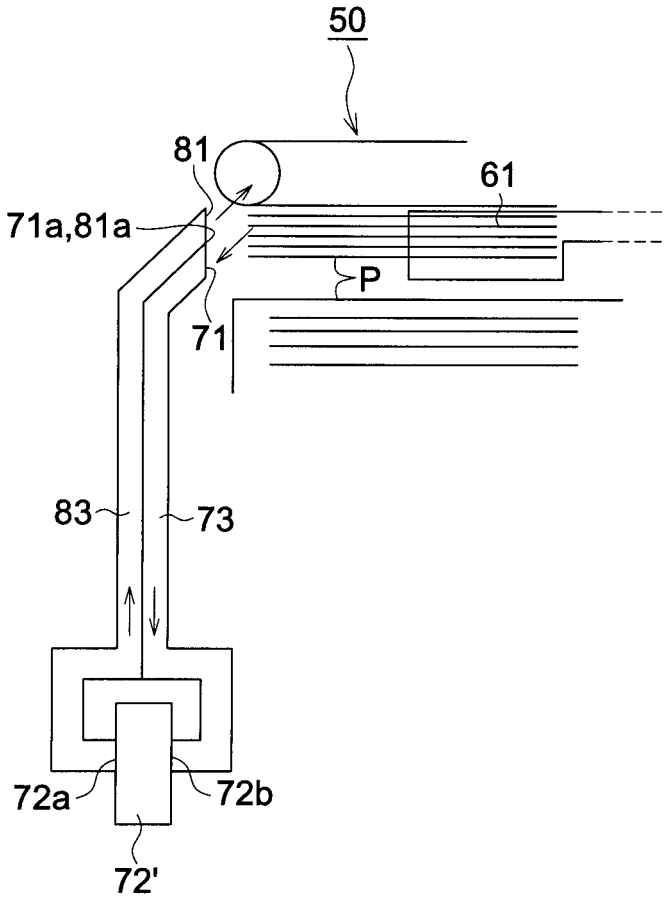
FIG. 5 is an explanatory diagram of other structures of the suction unit and the separation section.

FIG. 5 is an explanatory diagram of another configuration of the suction unit and the separation section.

FIG. 5 is a diagram that shows only the parts corresponding to the suction unit 80 and the separation section 70 of the sheet feeding apparatus LT of FIG. 2.

Since the parts other than the suction unit and the separation section are similar to those of the sheet feeding apparatus LT described already, the explanations of the parts other than the suction unit and the separation section are omitted.

This is one in which the suction mechanism of the suction unit 70 and the air blowing mechanism of the separation section 80 described with reference to FIG. 2 are combined (integrated) into a single mechanism.

An air flow duct 83 is connected to the air exhaust side of the third air blower 72', and superimposed sheets are separated by blowing air towards the conveying section 50 from the air ejection outlet 81, an air suction duct 73 is connected to the air suction side 72*b* of the third air blower 72', and the fluttering of the sheet is suppressed by sucking using the suction inlet 71 the air from the end face side of the floated sheet P.

Further, it is also possible to replace the air blower (the third air blower 72') with the suction unit, to connect the suction duct 73 on the air suction side of the suction unit, and to connect the second air blow duct 83 on the exhaust side.

Because of these, any one of the second air blower 82 and the suction device 72 explained referring to FIG. 2 becomes unnecessary, the configuration becomes simple, and it becomes possible to save on energy consumption.

Figure 6:
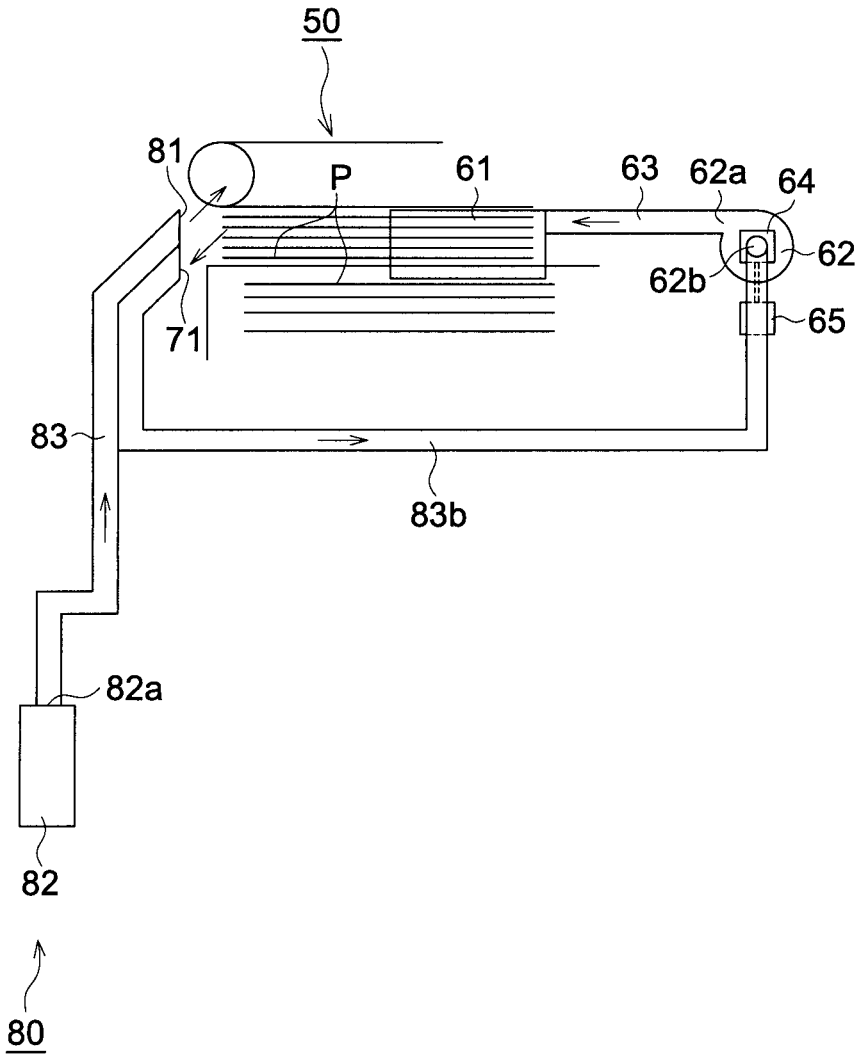
FIG. 6 is an explanatory diagram of other structures of the suction unit and the flotation section.

FIG. 6 is an explanatory diagram of another configuration of the suction unit and the flotation section.

FIG. 6 is a diagram that shows only the parts corresponding to the flotation section 60 and the suction unit 70 of the sheet feeding apparatus LT of FIG. 2.

Since the parts other than the suction unit and the flotation section are similar to those of the sheet feeding apparatus LT described already, the explanations of parts other than the suction unit and the flotation section are omitted.

This is one in which the suction mechanism of the suction device 72 and the air blowing function of the first air blower 62 described with reference to FIG. 2 are combined (integrated) into a single mechanism, as described above, and a first air blowing duct 63 is connected to the exhaust side 62*a* of the first air blower 62, air is ejected from the first air ejection outlet 61 towards the upper part end surface of the sheets P stacked on the stacking plate 41, and the topmost sheet stacked on the stacking plate 41 is made to float.

Further, an air suction duct 73*b* is connected to the air suction side 62*b* of the first air blower 62, air is sucked by the suction inlet 71 from the end surface of the floated sheet P, and the fluttering of the sheet is suppressed.

Because of this, the suction device 72 described referring to FIG. 2 becomes unnecessary, the configuration becomes simple, and it becomes possible to save on energy consumption.

DESCRIPTION OF SYMBOLS

40 Stacking section
50 Conveying section
51 Belt

60 Flotation section
61 First air ejection outlet
62 First air blower
65 Solenoid
70 Suction unit
71 Suction inlet
72 Suction unit
80 Separation section
81 Second air ejection outlet
82 Second air blower
A Image forming apparatus
LT Sheet feeding apparatus
P Sheet
S1 Sheet top surface detection sensor
S2 Suction confirmation detection sensor
S3 Sheet feeding detection sensor

The invention claimed is:

1. A sheet feeding apparatus comprising:
a stacking unit for stacking sheets on a stacking member,
a conveying unit for conveying sheets, wherein the conveying unit is placed above and spaced from said stacking unit,
a flotation unit that floats sheets in an upper part of the sheets stacked in said stacking unit towards said conveying unit, and
a suction unit comprising:
a suction inlet positioned underneath the conveying unit and above the stacking member, and
a suction device that sucks air from said suction inlet,
wherein the suction unit sucks air included in between a plurality of sheets floated by said flotation unit towards said conveying unit,
wherein said suction inlet is positioned on a downstream side from the tip end of the sheets stacked in the stacking unit in a direction of sheet conveying by said conveying unit and the suction inlet is opened in a direction perpendicular to the direction of sheet conveying by said conveying unit,
wherein said suction inlet is an opening that is provided on a lower side of a separation air blowing outlet that blows air towards said conveying unit, and that extends from a bottom edge of said separation air blowing outlet, in a vertical direction, by prescribed dimensions to a position located above a bottom edge of a flotation air blowing outlet that blows air towards an end surface of an upper part of the sheets stacked in said stacking unit,
said separation air blowing outlet is positioned on a downstream side from the tip end of the sheets stacked in the stacking unit in the direction of sheet conveying by said conveying unit, opens in a direction perpendicular to the direction of sheet conveying by said conveying unit, and
said flotation air blowing outlet opens in a direction parallel to the direction of sheet conveying by said conveying unit.

2. The sheet feeding apparatus according to claim 1, comprising a separation unit that, among the plurality of sheets that are floated by said floatation unit towards said conveying unit, separates a first sheet at a topmost part from the other sheets.

3. The sheet feeding apparatus according to claim 2, wherein said separation unit comprises:
the separation air blowing outlet that is positioned on a downstream side from the tip end of the sheets stacked in the stacking unit in a direction of sheet conveying by said conveying unit, the separation blowing outlet is opened in a direction perpendicular to the direction of sheet conveying by said sheet conveying unit and
a separation air blowing unit that blows air towards said separation air blowing outlet.

4. The sheet feeding apparatus according to claim 1, wherein said flotation unit comprises:
the flotation air blowing outlet that is opened in a direction parallel to a direction in which a sheet is conveyed by said sheet conveying unit and the flotation air blowing outlet blows air towards an end surface of an upper part of the sheets stacked in said stacking unit; and
an air blowing unit that blows air towards said flotation air blowing outlet.

5. The sheet feeding apparatus according to claim 1, wherein said conveying unit comprises:
a pair of rollers;
a driving motor that rotationally drives said rollers;
a belt stretched around and supported by said rollers;
a suction box that is placed inside said belt and sucks a sheet; and
a suction device that sucks air from the suction box.

6. The sheet feeding apparatus according to claim 1, wherein
the separation air blowing outlet that is positioned on a downstream side from the tip end of the sheets stacked in the stacking unit opens in a direction perpendicular to the direction of sheet conveying by said conveying unit and blows air towards said conveying unit;
a separation air blowing unit that blows air towards said second separation air blowing outlet is always ON when the sheet feeding apparatus is working and air is blown from said separation air blowing outlet;
the suction inlet that is positioned on a downstream side from the tip end of the sheets stacked in the stacking unit opens in a direction perpendicular to the direction of sheet conveying by said conveying unit; and
the suction device that sucks air from said suction inlet is always ON when the sheet feeding apparatus is working and air is sucked from said suction let.

7. An image forming system comprising:
a sheet feeding apparatus including:
a stacking unit for stacking sheets on a stacking member,
a conveying unit for conveying sheets, the conveying unit is placed above and spaced from said stacking unit,
a flotation unit that floats sheets in an upper part of the sheets stacked in said stacking unit towards said conveying unit, and
a suction unit comprising:
a suction inlet positioned underneath the conveying unit and above the stacking member, and
a suction device that sucks air from said suction inlet, wherein the suction unit sucks air included in between a plurality of sheets floated by said flotation unit towards said conveying unit; and
an image forming apparatus that is connected to said sheet forming apparatus on a downstream side of said sheet feeding apparatus and forms images,
wherein said suction inlet is positioned on a downstream side from the tip end of the sheets stacked in the stacking unit in a direction of sheet conveying by said conveying unit and the suction inlet is opened in a direction perpendicular to the direction of sheet conveying by said conveying unit,
wherein said suction inlet is an opening that is provided on a lower side of a separation air blowing outlet that blows air towards said conveying unit, and that extends from a bottom edge of said separation air blowing outlet, in a vertical direction, by prescribed dimensions to a position located above a bottom edge of a flotation air blowing outlet that blows air towards an end surface of an upper part of the sheets stacked in said stacking unit, said separation air blowing outlet is positioned on a downstream side from the tip end of the sheets stacked in the stacking unit in the direction of sheet conveying by said conveying unit, opens in a direction perpendicular to the direction of sheet conveying by said conveying unit, and said flotation air blowing outlet opens in a direction parallel to the direction of sheet conveying by said conveying unit.

* * * * *